United States Patent [19]

Steinbach

[11] 4,249,402

[45] Feb. 10, 1981

[54] KEEPER LOCK FOR A SLIDE FASTENER

[75] Inventor: Robert L. Steinbach, Glendale Heights, Ill.

[73] Assignee: Chicago Lock Co., Chicago, Ill.

[21] Appl. No.: 36,523

[22] Filed: May 7, 1979

[51] Int. Cl.[3] ..... E05B 67/38

[52] U.S. Cl. ..... 70/68; 70/421

[58] Field of Search ..... 70/67, 68, 419, 421; 24/205.11 L

[56] References Cited

U.S. PATENT DOCUMENTS

| | | | |
|---|---|---|---|
| 3,070,986 | 1/1963 | Hart | 70/68 |
| 3,971,242 | 7/1976 | Mikos | 70/388 |
| 4,019,353 | 4/1977 | Christopher | 70/68 |
| 4,022,039 | 5/1977 | Mikos | 70/388 |

OTHER PUBLICATIONS

Chicago Lock Co. Catalog 176, Copyright 1976, pp. 1 & 26.

Chicago Lock Co. Part No. 1788-A, Drawing dated 12-15-61.

Chicago Lock Part No. 34-86-ST, Drawing dated 8--2-67.

Sketch showing lock like Part No. 1788-A in partly sectional and partly elevational view.

*Primary Examiner*—Robert L. Wolfe

*Attorney, Agent, or Firm*—Gerlach & O'Brien

[57] ABSTRACT

A single key-operated keeper lock for a zipper-type slide fastener includes a barrel assembly of a tubular barrel and an anvil fixed to and projecting radially from the barrel, a plug assembly of a lock cylinder rotatably received in the barrel and a keeper arm fixed to and projecting radially from the cylinder adjacent to a proximal end thereof, the plug assembly being rotatable relative to the barrel assembly between alternate positions for alternately securing a fastener element between the keeper arm and the anvil, and releasing the element, tumblers carried by the cylinder, movable into engagement with the barrel to prevent the relative rotation, and movable out of such engagement by insertion of a key in the cylinder in the direction of the axis of rotation, a locking bar reciprocally movable in the barrel rectilinearly along such axis between a base portion of the barrel and a distal end portion of the cylinder, the base portion defining a recess receiving the locking bar in each of the several positions of the locking bar along the axis to prevent relative rotation between the barrel and the locking bar, the distal end portion of the cylinder having a pair of flanges defining between them a recess receiving the locking bar to prevent relative rotation between the cylinder and the locking bar and thereby also between the plug assembly and the barrel assembly, a spring resiliently biasing the locking bar into the recess in the distal end portion, and a stem on the locking bar and received in the distal end portion of the cylinder for engagement by the key being inserted to move the locking bar out of the latter recess, thereby to free the plug assembly for rotation relative to the barrel assembly.

11 Claims, 6 Drawing Figures

KEEPER LOCK FOR A SLIDE FASTENER

BACKGROUND OF THE INVENTION

This invention relates to a keeper lock for a zipper-type slide fastener. More particularly, the invention relates to a single key-operated keeper lock having a cylinder lock mechanism which constitutes the primary locking structure, and also having a locking bar which cooperates with the cylinder lock mechanism to perform an auxiliary locking function.

U.S. Pat. No. 3,070,986 describes a keeper lock of the type with which the present invention is concerned. The keeper lock, having a cylinder lock mechanism, is designed for use in securing slide fasteners on bags or other containers or enclosures, as noted in the patent, and, with certain modifications, the lock continues in use. One modification, of interest in connection with the present invention, involves the provision at the base of the lock cylinder of a pair of axially outwardly projecting flanges defining a recess between them, which recess serves to receive a flat spring pinned to the barrel in which the cylinder is received. A stem on the spring extends into the keyway of the cylinder. Insertion of a key into the cylinder both adjusts the tumblers and engages the stem to remove the spring from the recess, thereby enabling the lock cylinder to be rotated and the lock to be opened. The structure serves, inter alia, to increase the pick-resistance of the lock, inasmuch as it is necessary to perform a function of the key additional to the conventional tumbler adjustment function, in order to open the lock without the key.

The modified patent structure has the disadvantage in providing pick-resistance that the flat spring may be bent out of shape by a tool inserted through the lock, so that only the tumblers perform a locking function. Moreover, when the spring is moved out of the recess, it and the stem projecting into the lock cylinder therefrom are moved in a curved path, so that the stem may catch on other structure and hold the spring out of the recess, where it will not perform a locking function.

Another single key-operated lock having a cylinder lock mechanism and also employing a locking bar to perform an auxiliary locking function is disclosed in Chicago Lock Co. Catalog 176, copyright 1976, on page 26 thereof, wherein the structure is referred to as "Chicago Double Bitted Special Coincidental Locking Feature." In this structure, the locking bar is carried by the lock cylinder, and the locking bar must engage the surrounding barrel in the tumbler grooves. Both the lock cylinder and the surrounding barrel are specially constructed for cooperation with the locking bar.

A keeper lock basically constructed as disclosed in the above-identified patent is a desirable lock, inasmuch as it functions well in its intended applications, and it has a simple and economical structure, in general commensurate with the security required and the cost acceptable in its applications. Nevertheless, it would be advantageous to increase the security of the lock at a relatively low increase in the cost of manufacture.

SUMMARY OF THE INVENTION

The invention provides a keeper lock for a zipper-type slide fastener, which at relatively little additional cost incorporates auxiliary locking structure imparting increased pick-resistance to the lock of the above-identified patent. More particularly, the lock includes a new and improved combination of a locking bar and other structure which provides an additional locking function.

As compared to the above-described lock having a flat spring performing a locking function, the auxiliary locking structure of the present invention is much more rugged and reliable. As compared to the above-described coincidental locking feature of Catalog 176, the auxiliary locking structure of the invention is better adapted for minimizing play between the lock cylinder and the barrel in which the cylinder is received, and is sturdier and more economical. Moreover, the present invention may utilize the lock cylinder which is in current use in the above-described modified patent structure.

In the invention, structure which interlocks the locking bar and the barrel is separate and independent from the structure which interlocks the tumblers and the barrel; the barrel requires but relatively little structure in addition to the prior structure, for cooperation with the locking bar; and manufacture of the barrel may continue to be accomplished economically by die casting. An accompanying feature of the invention is that the barrel may be provided with a closed base or inner end, to prevent access to the working parts thereat.

A keeper lock to which the invention is directed more specifically includes a barrel assembly of a tubular barrel and an anvil fixed to and projecting radially from the barrel, a plug assembly of a lock cylinder rotatably received in the barrel and a keeper arm fixed to and projecting radially from the cylinder adjacent to a proximal end thereof, the plug assembly being rotatable relative to the barrel assembly about the longitudinal axis of the cylinder between a first position wherein the keeper arm overlies the anvil to secure a fastener element therebetween and a second position wherein the keeper arm is angularly offset from the anvil to permit access to the fastener element for manipulation thereof, and tumbler means carried by the cylinder and movable into engagement with the barrel to prevent the aforesaid relative rotation, such tumbler means being movable out of its engagement in response to movement of a key inserted in the cylinder longitudinally from its proximal end and engaging the tumbler means.

In accordance with the invention, the improved structure additionally includes a locking bar reciprocally movable in the barrel rectilinearly along the aforesaid axis between a base portion of the barrel and a distal end portion of the cylinder, the base portion having means for engaging the locking bar in each of the several positions of the locking bar along the axis to prevent relative rotation between the barrel and the locking bar, the distal end portion having means for engaging the locking bar to prevent relative rotation between the cylinder and the locking bar and thereby also between the plug assembly and the barrel assembly, means resiliently biasing the locking bar into engagement with the engaging means of the distal end portion, and means engageable by the key inserted in the cylinder for moving the locking bar out of the latter engagement in response to movement of the key, thereby to free the plug assembly for rotation thereof relative to the barrel assembly.

BRIEF DESCRIPTION OF THE DRAWINGS

The attached drawings illustrate a preferred embodiment of the invention, without limitation thereto. In the drawings, like elements are identified by like reference symbols in each of the views, and.

DESCRIPTION OF THE PREFERRED EMBODIMENT

Figure 1:
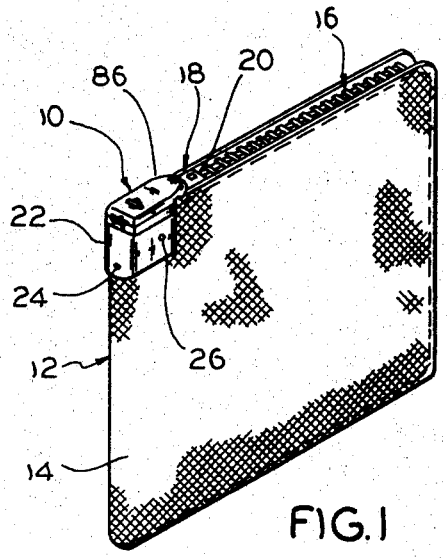
FIG. 1 is a perspective view of a money bag having the keeper lock of the invention mounted thereon and locking a slide fastener thereof.

Referring to FIG. 1 of the drawings, a keeper lock 10 constituting a preferred embodiment of the invention is illustrated as it is employed on a money bag 12 of the like. The bag 12 includes a flexible, envelope-like pouch 14 formed of a single generally rectangular sheet of canvass, cloth, duffel or other strong material. The sheet is folded upon itself, and the edges thereof are joined together in the usual manner of construction of such a bag. A conventional zipper-type slide fastener 16 serves to open and close an entrance opening into the bag 12. The slide fastener 16 includes the usual slide member 18, only the pull tab 20 of which is visible. The lock 10 is mounted on the bag 12 at one corner of the pouch 14, and a reinforcing element 22 in the form of a piece of leather or other suitable member is wrapped around the pouch and the lock at that corner. Rivets 24 and 26 extend through the reinforcing element 22, the pouch 14 and the lock 10, to secure them tightly together. The details of construction of the bag 12 and its assembly with the lock 10 essentially are the same as those described in the above-identified patent, and also are like those described in U.S. Pat. No. 4,019,353.

Referring to FIGS. 2–6, the keeper lock 10 includes a barrel assembly 28 and a plug assembly 30. The plug assembly 30, with the exception of certain improved structure minimizing play between the assemblies, described hereinafter, is like the prior art structure described hereinabove, constituting a modification of similar structure in U.S. Pat. No. 3,070,986. The barrel assembly 28 is similar to prior art barrel assemblies, but includes additional structure functioning as part of the auxiliary locking structure and increasing the resistance to picking, as described hereinafter. The illustrative lock 10 is operated by a single-bitted key 32, illustrated in FIG. 4.

The barrel assembly 28 includes a tubular barrel or body 34, and an anvil 36 fixed to and projecting radially from the barrel. A rim flange 38 projects outwardly from the barrel 34 on three sides and at an open end 40 of the barrel, such end also being referred to as the upper end. An arcuate mounting flange 42 extends from a closed or lower end 44 of the barrel. The mounting flange 42 is provided with a mounting hole 46 (FIGS. 3 and 4), through which the rivet 24 extends, for mounting the lock 10 on the bag 12.

The barrel 34 is provided with a cylindrical bore 48 having a vertical axis 50, and with a shallow counterbore 52 at its upper end 40. The inside of the barrel 34 is formed to provide front and back vertically extending (in general use as illustrated) arcuate longitudinal lands 54 and 56, respectively, having the inside diameter of the bore 48 and being spaced apart therearound, approximately in diametrically opposed relation to each other. The lands 54 and 56 define front and back arcuate longitudinal tumbler and lug-receiving grooves 58 and 60, respectively, between them, which likewise are approximately in diametrically opposed relation to each other. The diameters of the grooves 58 and 60 are the same as the diameter of the counterbore 52. The lands 54 and 56 and the grooves 58 and 60 extend downwardly from the counterbore 52 for a major portion of the height of the bore 48, to a location spaced above an imperforate base portion 62 of the barrel. An annular internal retaining ring-receiving groove 64 is provided in the wall of the bore 48, at an elevation intermediate the lower ends of the lands 54,56 and the grooves 58,60, and the base portion 62.

Figure 3:
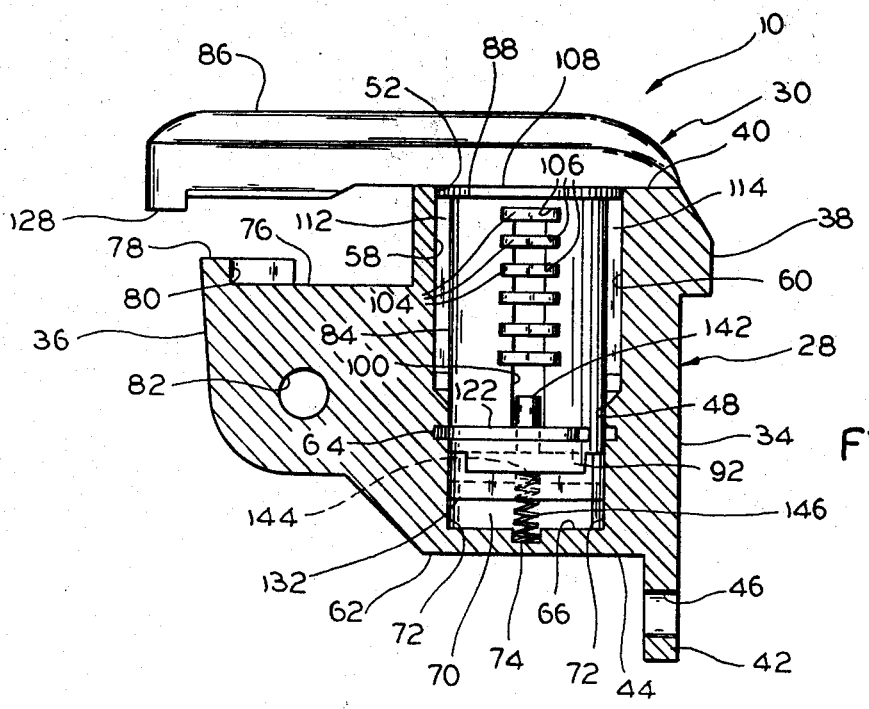
FIG. 3 is an enlarged central longitudinal and vertical sectional view of the lock, with certain parts in elevation, illustrating the lock in its locking condition.
Figure 6:
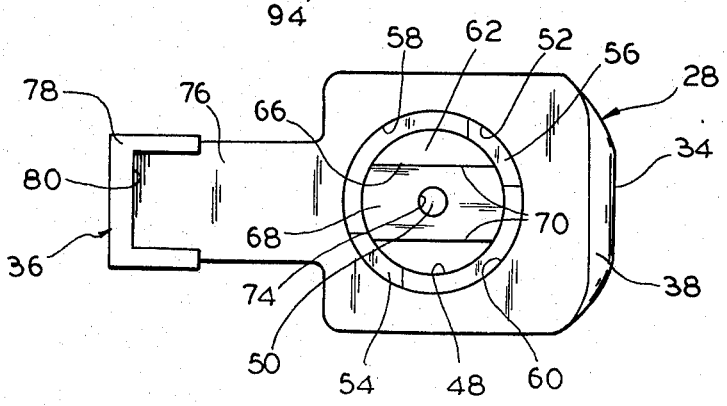
FIG. 6 is a top plan view of a barrel assembly in the lock.

Referring particularly to FIGS. 3 and 6, the base portion 62 defines an elongated diametrical locking bar-receiving recess 66, which faces upwardly. The recess 66 is bounded by a diametrical horizontal planar bottom surface 68, two spaced parallel opposite vertical or upstanding planar side wall surfaces 70, and two spaced opposite arcuate end wall surfaces 72 constituting downward extensions of the bore 48. A spring-receiving blind bore 74 extends axially downwardly from the bottom surface 68 into the base portion 62.

Figure 2:
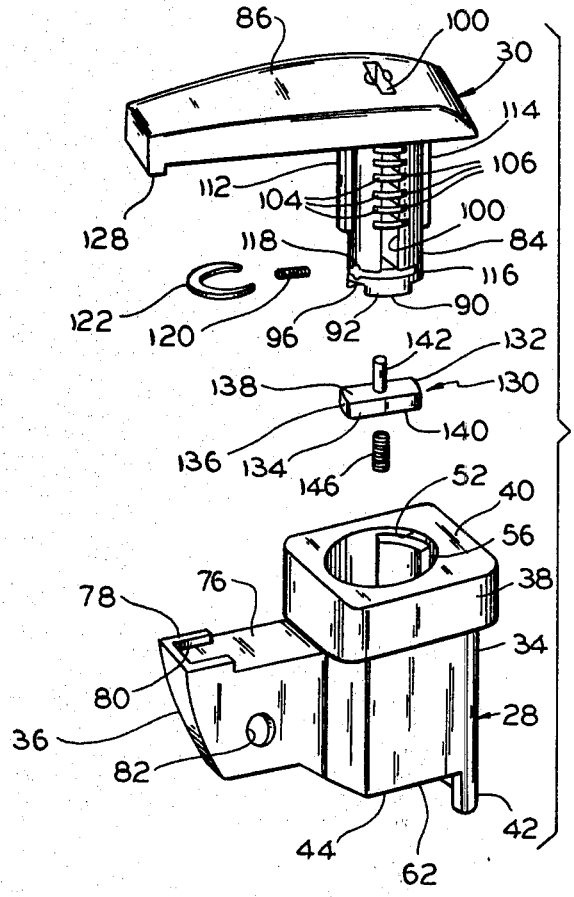
FIG. 2 is an exploded perspective view of the lock, illustrating the parts oriented in the positions they assume when the lock is in its locking condition.

Referring to FIGS. 2 and 6, a generally rectangular, flat horizontal seating surface 76 is provided on top of the anvil 36. The outer end of the seating surface 76 is bounded by an upwardly projecting U-shaped retaining flange 78, which forms a retention pocket 80 with the seating surface. A mounting hole 82 extends transversely through the anvil 36, and the rivet 26 (FIG. 1) extends through the mounting hole.

Referring to FIGS. 2–5, the plug assembly 30 includes a plate tumbler-type lock cylinder 84 rotatably received in the barrel 34, and a keeper arm 86 integrally fixed to and projecting radially from the cylinder adjacent to a proximal end 88 thereof. A distal end portion 90 of the cylinder 84 includes a pair of spaced apart locking flanges 92, having the outlines of segments of a circle, which project outwardly or downwardly in the direction of the axis 94 of the cylinder. The flanges 92 define an elongated diametrical locking bar-receiving recess 96 between them. The recess 96 is bounded by spaced parallel vertical planar inner surfaces 98 on the locking flanges 92, and by an elongated diametrical horizontal planar base surface 99 on the cylinder. The lock cylinder 84 is received closely within the bore 48 of the barrel 34, with the cylinder and bore axes 94 and 50 coincident, and with the cylinder recess 96 facing the base portion recess 66 therein.

A keyway 100 extends through the keeper arm 86 and axially through the lock cylinder 84, and it terminates in spaced relation to the base surface 99. An axial stem hole 102 extends through the distal end portion 90 of the cylinder 84, from the base surface 99 to the keyway 100. Spring-pressed plate tumblers 104, six in the illustrative embodiment, are reciprocally slidably movable in the transverse direction, in respective tumbler grooves 106 provided in the lock cylinder 84 and extending radially with respect to its axis 94.

The lock cylinder 84 makes use of the available structure of the lock cylinder in current use, referred to earlier in the disclosure, to perform the additional locking function provided by the invention. In particular, the flanges 92, the bar-receiving recess 96, and the stem hole 102 registering with the keyway 100 are utilized for such purpose, as described hereinafter. The construction and mounting of the tumblers 104, and their operation by the key 32 are conventional, being as described in the above-identified patents, and they are the same as employed with the current lock cylinder.

A shallow cylindrical plug section 108 is provided on the plug assembly 30, between the proximal end 88 of the cylinder 84 and the under or inner surface 110 of the keeper arm 86. The diameter of the plug section 108 is substantially the same as the diameter of the counterbore 52 in the barrel 34. A pair of arcuate longitudinal external front and back stop lugs 112 and 114, respectively, are provided on the outer surface of the cylinder 84 integrally therewith, in spaced apart relation therearound and approximately in diametrically opposed relation to each other. The outside diameters of the lugs 112 and 114 are the same as the diameter of the plug section 108. The lugs 112 and 114 extend downwardly, in the direction of the cylinder axis 94, from the plug section 108 to locations between the lowermost tumbler groove 106 and the cylinder base surface 99. A crescent-shaped retaining ring-mounting groove 116 is provided in the outer surface of the cylinder 84 therearound, adjacent to the bottom of the keyway 100. A radially extending cylindrical spring-receiving recess 118 is provided in the lock cylinder 84 at the center of the groove 116, as seen in FIG. 2. A coil compression retaining ring spring 120 is inserted in the recess 118, and a crescent-shaped retaining ring 122 is inserted in the groove 116 and urged outwardly by the spring 120 therebehind.

Figure 5:
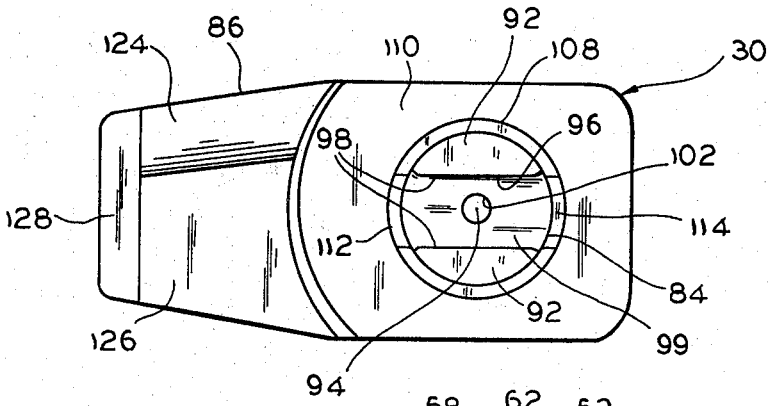
FIG. 5 is a bottom plan view of a plug assembly in the lock.

Referring particularly to FIG. 5, an inwardly and outwardly or downwardly inclined flat cam surface 124 is formed on the keeper arm 86, adjacent to the undersurface 110 surrounding the cylinder 84. The cam surface 124 terminates at a generally flat horizontal bearing surface 126, adjacent to the undersurface 110. A transverse rib or boss 128 on the keeper arm 86 extends downwardly at the outer end of the arm and adjacent to the cam and bearing surfaces 124 and 126.

Figure 4:
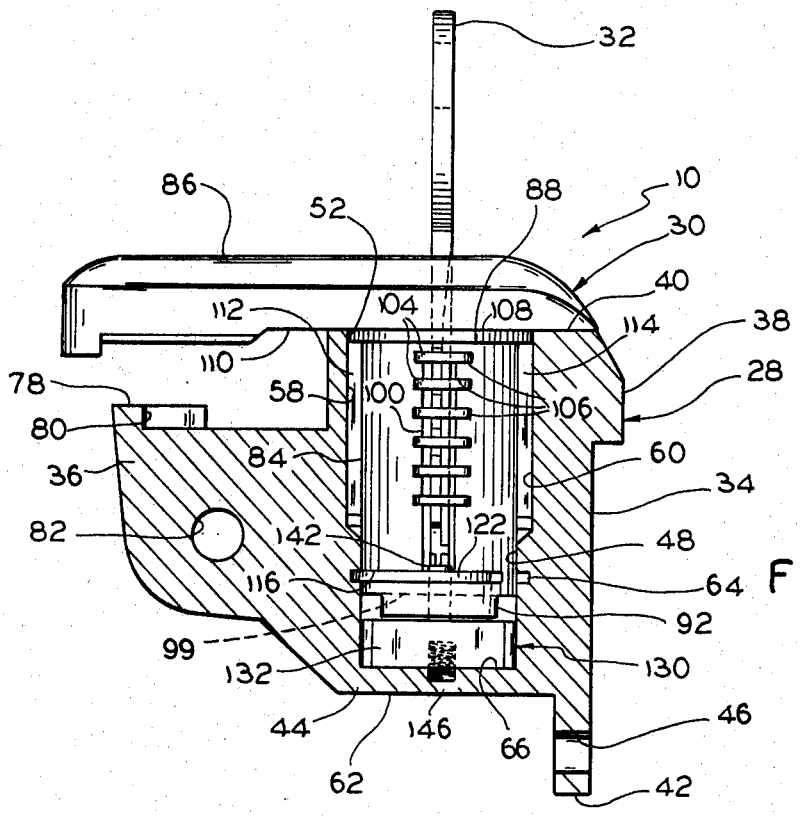
FIG. 4 is a view like FIG. 3, but showing the lock with a key inserted therein, to enable the lock to be placed in its unlocking condition.

The keeper lock 10 also includes a locking component 130, seen in FIGS. 2–4. The locking component includes an elongated locking bar or block 132 having vertical or upstanding parallel planar side surfaces 134, vertical or upstanding arcuate end surfaces 136, and elongated horizontal planar top and bottom surfaces 138 and 140, respectively. The locking component 130 also includes a cylindrical stem 142 which projects vertically upwardly from the center of the top surface 138 of the locking bar, integrally therewith. The stem 138 has a diameter slightly less than the diameter of the cylindrical stem hole 102 in the cylinder 84. A cylindrical spring-receiving recess 144 (FIG. 3) extends upwardly or inwardly from the bottom surface 140 of the locking bar 132. A coil compression locking spring 146 is received in the recess 144 in the locking bar 132, and also in the spring-receiving recess 74 in the base portion 62 of the barrel 34.

The locking bar 132 is dimensioned so that it may be received completely within the bar-receiving recess 66 in the barrel, as illustrated in FIG. 4. When so received, the side surfaces 134 of the locking bar are adjacent and substantially parallel to the side wall surface 70 of the recess 66, the arcuate end surfaces 136 of the locking bar are adjacent to and substantially concentric with the end wall surfaces 72 bounding the recess 66, and the stem 142 is coaxial with the axis 50 of the barrel bore 48. The locking bar 132 also may be received in the bar-receiving recess 96 of the lock cylinder, to the extent of a substantial portion of the depth of the locking bar, as illustrated in FIG. 3. When so received, the side surfaces 134 of the locking bar are adjacent and substantially parallel to the inner surfaces 98 of the locking flanges 92, and the arcuate end surfaces 136 of the locking bar are substantially concentric with and have the same radius as the lock cylinder 84. At this time, the stem 142 is received in the stem hole 102, coaxial with the axis 94 of the cylinder.

The lock 10 is assembled with the cylinder 84 inserted in the bore 48 and with the front and back stop lugs 112 and 114 inserted in respective front and back tumbler and lug-receiving grooves 58 and 60. The retaining ring spring 120 is received in the recess 118 provided therefor in the cylinder 84, and the retaining ring 122 in part is received in the ring-mounting groove 116 in the cylinder. The retaining ring 122, under the bias of its spring 120, in part also is received in the ring-receiving groove 64 provided in the wall of the barrel 34, as illustrated in FIGS. 3 and 4, thereby securing the lock cylinder 84 rotatably in the barrel.

In the locking condition of the lock 10, the ends of the tumblers 104 on one side of the lock cylinder 84 project outwardly from the cylinder, under spring bias, and into the front tumbler and lug-receiving groove 58 in the adjacent side of the barrel 34. The edges of the tumbler ends lie adjacent to the back land 56 in the barrel, to prevent clockwise rotation (as viewed from the top) of the plug assembly 30 with respect to the barrel assembly 28. The stop lugs 112 and 114 lie adjacent to the front and back lands 54 and 56, respectively, thereby to prevent counterclockwise rotation of the plug assembly 30 relative to the barrel assembly 28. Insertion of the key 32 in the keyway 100 and into engagement with the tumblers 104 moves the tumblers to withdraw the projecting tumbler ends from the front tumbler and lug-receiving groove 58, until the tumblers are within the confines of the lock cylinder 84. During the insertion of the key 32, the opposite ends of the tumblers 104 may at times project into the back tumbler and lug-receiving groove 60. With the key 32 inserted in the lock 10, the lock cylinder when not otherwise impeded is rotatable in the clockwise direction, until the front and back stop lugs 112 and 114 engage the back and front lands 56 and 54, respectively, which in the illustrative embodiment amounts to a rotation of about 90°. The foregoing structure and operation is conventional.

A feature of the structure of the lock 10 which, however, is not conventional, but constitutes an improvement provided by the present invention, is the combination of the plug section 108 adjacent to the keeper arm 86 of the plug assembly 30, and the means providing the counterbore 52 at the top of the barrel 34. The plug section 108 is closely received within the counterbore 52, so as to minimize play between the plug assembly 30 and the barrel assembly 28. Thus, the plug section 108 has a peripheral surface which bears on the wall of the barrel completely therearound, essentially preventing any tilting or twisting movement of the keeper arm 86 relative to the barrel 34. This feature reduces the susceptibility to picking.

The locking component 130 is mounted in the barrel 34 for reciprocal movement rectilinearly along the coincident axes 50 and 94, with the locking bar 132 moving between the base portion 62 of the barrel and the distal end portion 90 of the lock cylinder 84. Referring to FIGS. 2, 3, 5 and 6, in the locking condition, the stem 142 of the locking bar 132 is received in the stem hole 102 and extends into the keyway 100, where it is engageable by the key 32. The upper portion of the locking bar 132 is received in the lock cylinder bar-receiving recess 96, and the lower portion of the locking bar is received in the barrel bar-receiving recess 66 at the same time. The locking spring 146 exerts pressure on the locking bar 132 from beneath, so that the top surface 138 of the locking bar bears against the base surface 99 of the cylinder 84, and the stem 142 is inserted into the keyway 100 to its fullest extent. The bottom surface 140 of the locking bar is spaced above the surface 68 at the bottom of the barrel recess 66.

In the foregoing manner, the base portion 62 of the barrel 34 and the locking bar 132 are interlocked to prevent relative rotation between them, and the lock cylinder 84 and the locking bar also are interlocked to prevent relative rotation between them. Consequently, each of the cylinder 84, the locking bar 132, and the barrel 34 is prevented from rotation relative to any of the others, and relative rotation between the plug assembly 30 and the barrel assembly 28 is prevented. Thus, the plug assembly 30 is prevented from rotating relative to the barrel assembly 28 by two agencies, i.e., the tumblers 104 engaging the back land 56, and the locking bar 132 interengaging the assemblies.

Insertion of the key 32 in the keyway 100, in the direction of the coincident axes 50 and 94, until in its fully inserted position, serves to draw the tumblers 104 into the cylinder 84, and move the locking component stem 142 to a lower position in the keyway, as illustrated in FIG. 4. The movement of the stem 142 serves to move the locking component 130 downwardly, so that the locking bar 132 is removed from the bar-receiving recess 96 at the base of the lock cylinder 84 and spaced slightly therebelow, within the bar-receiving recess 66 in the base portion 62 of the barrel. The plug assembly 30 then may be rotated relative to the barrel assembly 28, in the clockwise direction, with the cylinder 84 rotating about the stem 142 in the stem hole 102 and the keyway 100. The keeper arm 86 rotates from a locking position disposed over the anvil 36 to an unlocking position angularly offset from the anvil. The key 32 may be removed from the keyway 100 after such rotation, if desired.

With the key 32 removed following the rotation, the formerly projecting ends of the tumblers 104 are held within the cylinder 84 by engagement with the rear land 56 previously abutting the tumbler ends, while the opposite ends of the tumblers register with the front tumbler and lug-receiving groove 58. The locking bar 132 engages the outer end surfaces of the flanges 92, thereby remaining out of the cylinder bar-receiving recess 96. Subsequent counterclockwise rotation of the plug assembly 30 causes the tumblers 104 to extend into the front tumbler and lug-receiving groove 58 under the pressure of the tumbler springs, and the locking bar 132 to move upwardly into the bar-receiving recess 96 of the cylinder 84 under the pressure of the locking spring 146, whereby the plug assembly is restored to its locking condition.

The manner in which the lock 10 cooperates with the slide fastener 16 to lock the fastener with the bag 12 closed is conventional and described in the above-identified patents. Briefly, as the keeper arm 86 is swung or rotated counterclockwise from its offset position to its locking position, illustrated in FIGS. 1–4, the cam surface 124 on the keeper arm contacts the slide member 18, and cams a portion thereof (not shown) into the pocket 80, after which such portion is contacted by and maintained within the pocket by the bearing surface 126 on the keeper arm. The rib 128 on the keeper arm moves into a position overlying the pull tab 20, and thereafter serves to hold it down. Consequently, the pull tab 20 cannot be raised for operating the slide member, and the portion in the pocket 80 cannot be removed therefrom, so that the slide fastener 16 is locked effectively, and the bag 12 cannot be opened. Clockwise rotation of the keeper arm 86 to the offset position frees the fastener 16 for manipulation to open the bag 12.

Picking the lock 10 of the invention necessitates several simultaneous operations with corresponding tools, while there is but limited access room in the keyway 100. Thus, it is necessary to apply torque to the plug assembly 30, disengage the locking component 130 from the lock cylinder 84 and maintain the disengagement, and pick a tumbler or tumblers 104, all at the same time. In view of the relative complexity of the necessary operations and the lack of working room in the keyway, the pick-resistance of the lock is materially increased. The pick-resistance is further increased by the above-described structure of the plug section 108 received in the counterbore 52, which cooperate to prevent misalignment of the plug assembly 30 on the barrel assembly 28. Moreover, in addition to cooperating with the locking component 130, the base portion 62 closes the bottom of the barrel 34, to prevent entry of a tool inserted into the pouch 14 beneath the lock.

Although the keeper lock 10 has been illustrated as mounted on a money bag 12, it may be employed with a variety of other containers or enclosing means which employ slide fasteners as closures, for example, traveling cases, duffel bags, and tent flaps. While a preferred embodiment of the invention has been described and illustrated, it will be apparent to those skilled in the art that various changes and modifications may be made therein within the spirit and scope of the invention. It is intended that such changes and modifications be included within the scope of the appended claims.

I claim:

1. In a keeper lock for a zipper-type slide fastener, said lock including a barrel assembly of a tubular barrel and an anvil fixed to and projecting radially from the barrel, a plug assembly of a lock cylinder rotatably received in said barrel and a keeper arm fixed to and projecting radially from the cylinder adjacent to a proximal end thereof, said plug assembly being rotatable relative to said barrel assembly about the longitudinal axis of said cylinder between a first position wherein said keeper arm overlies said anvil to secure a fastener member therebetween and a second position wherein said keeper arm is angularly offset from the anvil to permit access to the fastener member for manipulation thereof, and tumbler means carried by said cylinder and movable into engagement with said barrel to prevent said relative rotation, said tumbler means being movable out of said engagement in response to movement of a key inserted in said cylinder longitudinally from said proximal end and engaging the tumbler means, the improvement which comprises:

a locking bar reciprocally movable in said barrel rectilinearly along said axis between a base portion of the barrel and a distal end portion of said cylinder, said base portion having means for engaging said locking bar in each of the several positions of the locking bar along said axis to prevent relative rotation between the barrel and the locking bar, said distal end portion having means for engaging said locking bar to prevent relative rotation between the cylinder and the locking bar and thereby also between the plug assembly and the barrel assembly, means resiliently biasing said locking bar into engagement with said engaging means of said distal end portion, and means engageable by a key which also engages said tumbler means for the latter movement thereof, for moving said locking bar out of its latter engagement in response to movement of the key, thereby to free the plug assembly for said rotation thereof relative to the barrel assembly.

2. A lock as defined in claim 1 and wherein said means engageable by a key comprises a stem on said locking bar and received in said cylinder at its distal end.

3. A lock as defined in claim 1 and wherein said engaging means of said base portion defines a recess receiving said locking bar therein.

4. A lock as defined in claim 3 and wherein said base portion closes the base of the barrel.

5. A lock as defined in claim 3 and wherein said engaging means of said distal end portion defines a recess receiving said locking bar therein.

6. A lock as defined in claim 1 and wherein said biasing means comprises a compression spring interposed between said locking bar and said base portion.

7. A lock as defined in claim 1 and wherein said tumbler means comprises a plurality of plate tumblers, and including a pair of longitudinal lands spaced apart around the inside of said barrel and defining a pair of longitudinal grooves between them, a pair of longitudinal stop lugs spaced apart around the outside of said cylinder, said grooves serving to receive said stop lugs and the ends of said tumblers, and means providing a cylindrical bore section in said barrel adjacent to said keeper arm, said plug assembly having a cylindrical plug section adjacent to said keeper arm and received closely within said bore section to minimize play between said assemblies.

8. In a keeper lock for a zipper-type slide fastener, said lock including a barrel assembly of a tubular barrel and an anvil fixed to and projecting radially from the barrel, a plug assembly of a lock cylinder rotatably received in said barrel and a keeper arm fixed to and projecting radially from the cylinder adjacent to a proximal end thereof, a distal end portion of said cylinder having a pair of flanges projecting outwardly in the direction of the longitudinal axis of the cylinder and defining a recess between them, said cylinder also having a keyway therein extending longitudinally from said proximal end and a hole extending longitudinally through said distal end portion from said recess to said keyway, said plug assembly being rotatable relative to said barrel assembly about said axis between a first position wherein said keeper arm overlies said anvil to secure a fastener member therebetween and a second position wherein said keeper arm is angularly offset from the anvil to permit access to the fastener member for manipulation thereof, and tumbler means carried by said cylinder and movable into engagement with said barrel to prevent said relative rotation, said tumbler means being movable out of said engagement in response to movement of a key inserted in said keyway from said proximal end and engaging the tumbler means, the improvement which comprises:

a locking component including a locking bar and a stem projecting therefrom, said locking component being reciprocally movable in said barrel rectilinearly along said axis with said locking bar moving between a base portion of the barrel and said distal end portion, said base portion defining a recess facing said recess in the distal end portion and receiving said locking bar in each of the several positions of the locking component along said axis to prevent relative rotation between the barrel and the locking bar, said hole in the distal end portion and said keyway receiving said stem for relative rotational and longitudinal reciprocal movement therein, said locking bar also being receivable in said recess in the distal end portion to prevent relative rotation between the cylinder and the locking bar and thereby also between the plug assembly and the barrel assembly, and means resiliently biasing said locking component into a position wherein said locking bar is received in said recess in the distal end portion, said stem being engageable by a key which also engages said tumbler means for the latter movement thereof, for moving said locking component out of the latter position in response to movement of the key, thereby to free the plug assembly for said rotation thereof relative to the barrel assembly.

9. A lock as defined in claim 8 and wherein said biasing means comprises a compression spring interposed between said locking bar and said base portion.

10. A lock as defined in claim 9 and wherein said base portion closes the base of the barrel.

11. A lock as defined in claim 8 and wherein said tumbler means comprises a plurality of plate tumblers, and including a pair of longitudinal lands spaced apart around the inside of said barrel and defining a pair of longitudinal grooves between them, a pair of longitudinal stop lugs spaced apart around the outside of said cylinder, said grooves serving to receive said stop lugs and the ends of said tumblers, and means providing a cylindrical bore section in said barrel adjacent to said keeper arm, said plug assembly having a cylindrical plug section adjacent to said keeper arm and received closely within said bore section to minimize play between said assemblies.

* * * * *